United States Patent [19]

Daley et al.

[11] 4,020,940

[45] May 3, 1977

[54] RESILIENT COUPLING MEANS FOR RIBBON CARTRIDGE MOUNTING PLATE

[75] Inventors: Howard L. Daley, Dallas; Gerald S. Davidson, Plano; Svetislav Mitrovich, Dallas, all of Tex.

[73] Assignee: Xerox Corporation, Stamford, Conn.

[22] Filed: Aug. 18, 1975

[21] Appl. No.: 605,485

[52] U.S. Cl. ..... 197/151; 197/53

[51] Int. Cl.[2] ..... B41J 33/14

[58] Field of Search ..... 197/151, 168, 53

[56] References Cited

UNITED STATES PATENTS 3,731,781 5/1973 Caudill et al. ..... 197/151

*Primary Examiner*—Ernest T. Wright, Jr.

[57] ABSTRACT

A resilient coupling device for reducing the position excursions of the carriage of a serial impact printer during print time. The resilient coupling device comprises a spring means mounted between the ribbon associated components and the remaining components of the carriage.

2 Claims, 4 Drawing Figures

RESILIENT COUPLING MEANS FOR RIBBON CARTRIDGE MOUNTING PLATE

BACKGROUND OF THE INVENTION

This invention relates in general to impact printers and more particularly to the means for mounting the ribbon cartridge mounting plate to the carriage employed therewith.

The Diablo Corporation, a subsidiary of the present assignee, is marketing a serial printer under the tradename of Diablo Hytype I which employs a movable carriage with the ribbon cartridge mounted thereon. A printer of this type is disclosed in a U.S. patent application, filed Sept. 4, 1973, in the name of Andrew Gabor, Ser. No. 394,072, entitled "High Speed Printer with Intermittent Printer Wheel with Carriage Movement", now U.S. Pat. No. 3,954,163 being a continuation of an application filed Feb. 25, 1972, Ser. No. 229,314, now abandoned, the disclosure of which is incorporated by reference into this specification.

The Diablo Hytype I printer is enjoying commercial success as a serial printer in such applications as communication terminals, computer output devices, etc. However, in certain applications, such as automatic text editing typewriter applications in the office environment, additional features and capabilities are desired, e.g., higher print quality. In the text editing or office typing environment, the demands for high print quality cause the print wheel to be subjected to about ten times greater force due to about five times greater hammer energy compared to a Hytype I printer operating as a computer output terminal, for example. To provide the high print quality needed, the integrally molded thermoplastic print wheel of the Hytype I was replaced by a composite print wheel, such as that disclosed in a copending U.S. patent application Ser. No. 683,977, filed May 6, 1976, being a continuation of an application filed Sept. 25, 1974, in the name of Gordon Sohl et al., Ser. No. 509,193 now abandoned, and a different print hammer assembly was incorporated therein which provided greater hammer energy. A card guide was added to the carriage to assist the operator in inserting and aligning paper in the automatic text editing typewriter. One problem with this type of carriage, due to the geometry of the carriage (high mass center of the structure), is the resulting error in the horizontal alignment or positioning of the printed characters. The horizontal alignment or positioning of the printed characters exceeded the competitive print quality specification by about ±0.002 inch in the manual typing mode and about ±0.008 inch in the automatic typing mode. The predominate cause of the problem is the movement of the carriage during print time (i.e., when the character slug of the print wheel strikes the platen with reference to the start of hammer fire pulse).

Accordingly, it is a primary object of the present invention to provide an economical method and apparatus for reducing the horizontal alignment error of the printed characters in document creation equipment employing an impact printer along the presently described vane.

Another object of our invention is to provide a simple and reliable means to reduce the horizontal alignment error of the printed characters which is compatible with the existing carriage and which may be implemented without significantly increasing the bulk and complexity of the carriage.

Other objects and advantages will be evident from the specification and claims and the accompanying drawing illustrative of the invention.

SUMMARY OF THE INVENTION

The foregoing objects and others of the present invention are accomplished in accordance with this invention by the provision of resilient coupling means for the ribbon cartridge mounting plate. The resilient coupling means comprises coil springs which replace the prior art coupling components of spacers of a plastic material, such as acetal or "DELRIN" resins, and O-rings normally used in mounting the ribbon cartridge mounting plate to the carriage. By choosing coil springs with each spring having a spring rate within the critical range of about 4.0 lbs/in to about 30.0 lbs/in, the coupling between the ribbon associated components, associated with the ribbon cartridge mounting plate, and the other elements of the carriage is changed thereby reducing the dynamic mass of the carriage. The reduction in the dynamic mass of the carriage results in reduced carriage position excursions during print time and maintains the horizontal alignment or positioning of the printed characters within the print quality specification.

BRIEF DESCRIPTION OF THE DRAWING

Other advantages and features of the present invention may become more apparent from reading the following detailed description in connection with the drawing forming a part thereof, in which.

DESCRIPTION OF THE PREFERRED EMBODIMENT

Figure 1:
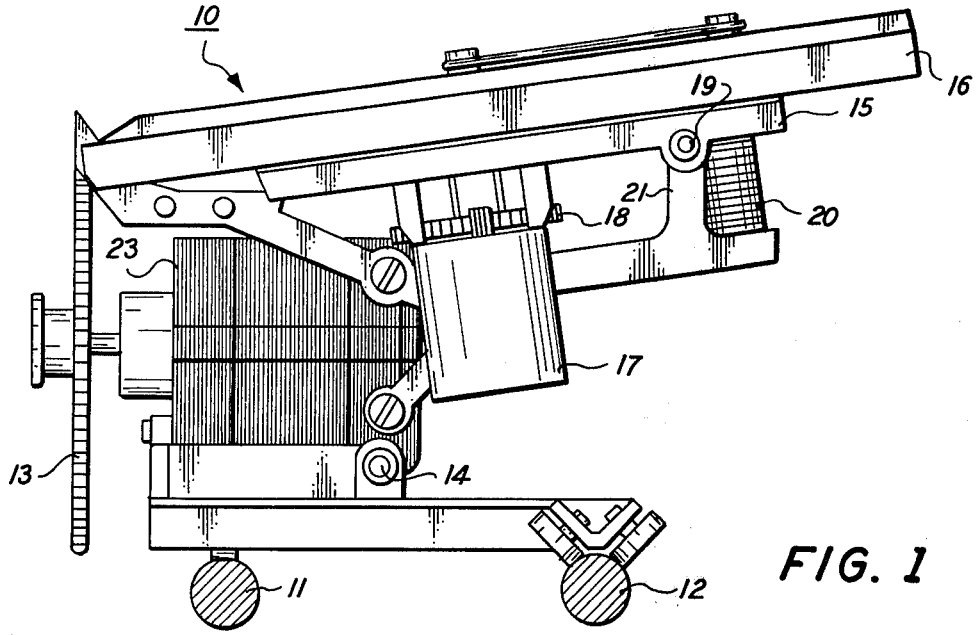
FIG. 1 is a side plan view of a printer carriage of the type embodying the principles of the present invention.
Figure 2:
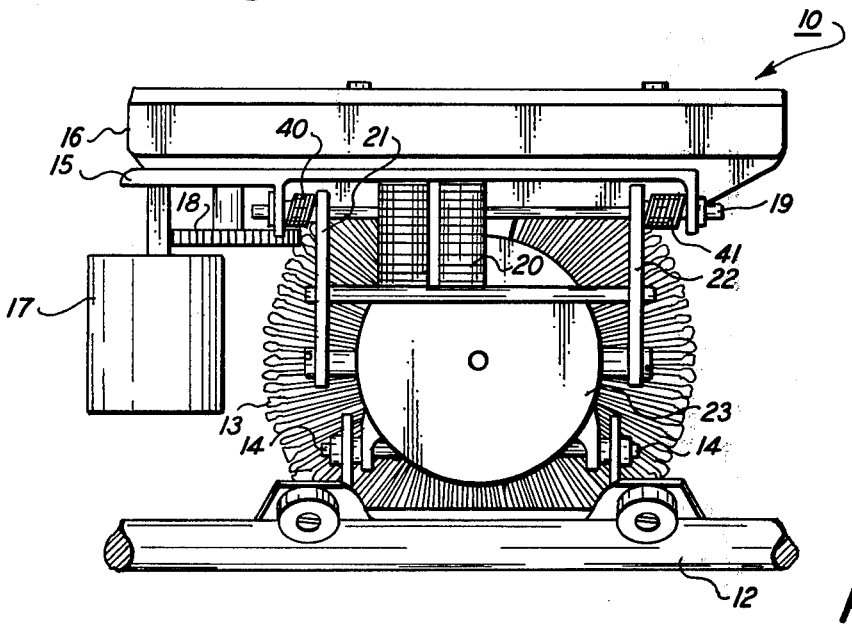
FIG. 2 is a rear plan view of FIG. 1.

Referring now to the drawing and more particularly to FIGS. 1 and 2, there is illustrated a printer carriage 10 mounted on rails 11 and 12. As typing of printed characters occurs, the carriage 10 stops each time a character is to be printed. Also, while the carriage 10 is moving from one location to the next location along rails 11 and 12 (by cable means not shown), the print wheel 13 is rotated by motor 23 such that the next character to be printed will be in position at the print station, located at 12 o'clock on the print wheel 13, when the carriage 10 stops and the print hammer (not shown) is fired. As seen in FIG. 1, the upper portion of carriage 10 is pivotable about shaft 14 with respect to the lower portion of carriage 10. This pivoting motion is necessary in order to bring the print wheel 13 up into a position such that it may be exchanged for a different print wheel 13.

The ribbon cartridge mounting plate 15 provides the mounting structure for the ribbon cartridge 16, the ribbon advance motor 17 and the ribbon advance gearing 18. The ribbon cartridge mounting plate 15 is pivotable in FIG. 1 about shaft 19. This pivoting motion is necessary to raise the ribbon from the down position, which allows the printed material to be viewed by the typist, to the up position at the print station when printing is to occur. The force to pivot the ribbon cartridge mounting plate 15 is a magnetic force supplied by electromagnet coils 20. When coils 20 are energized (by circuitry not shown), that portion of the ribbon cartridge mounting plate 15 above coils 20 is drawn down toward the coils 20 thereby raising that portion of the ribbon cartridge 16, which is near the print wheel 13, to the print position. During the manual mode of the automatic text editing typewriter, the typist enters character information into the memory and/or creates a copy on the typewriter printer at from 0.5 to 5.0 characters per second (cps). The typed information is manipulated by the electronics to arrange format etc., and an edited document is typed by the printer, in the automatic mode under control of the electronics, at speeds upward of 30 cps. It is readily apparent that the carriage 10 and print wheel 13 may be required to start and stop up to 30 times a second.

Figure 3:
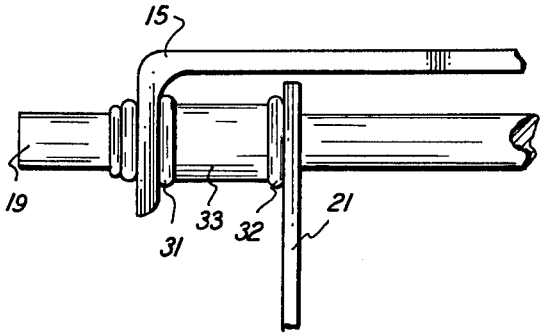
FIG. 3 PRIOR ART
FIG. 3 is an enlarged rear elevation view of a portion of the carriage of FIG. 2 showing the prior art mounting means for the ribbon cartridge mounting plate.

The rapid starting and stopping of the carriage 10 and the print wheel 13 during the printing operation sets up dynamic oscillations in the carriage 10. As shown in FIG. 3, the prior art means for mounting the ribbon cartridge mounting plate 15 included O-rings 31 and 32 and a DELRIN spacer or sleeve 33 located between the ribbon cartridge mounting plate 15 and the upward extending arm 21 of the upper portion of carriage 10. The distance between mounting plate 15 and arm 21 is about 0.25 inches. As is readily apparent from FIG. 2, only one-half of the mounting means (the left half) is shown in FIG. 3. The rigid coupling means between the ribbon cartridge mounting plate 15 and the arms 21 and 22 of the upper portion of carriage 10 caused the ribbon cartridge 16, the ribbon advance motor 17, the ribbon advance gearing 18 and the ribbon cartridge mounting plate 15 to amplify the vibrations or oscillations of the remaining parts of the carriage 10 during the rapid starting and stopping movement thereof. This amplification was due primarily to the geometry of the carriage 10 (the high mass center of the carriage 10) and to a close matching of the vibration frequency of the ribbon cartridge mounting plate 15 and the components mounted thereon to the mounting system frequency of the carriage 10 and the carriage mounting to rails 11 and 12. The above-noted information resulted from various tests of the carriage 10 in association with instrumentation which included high-speed movies and an Optron, Inc., electro-optical displacement follower.

The vibrations or oscillations of the various parts of the carriage 10 during the rapid stopping and starting of the carriage 10 lasted during the print time (i.e., when the character slug of the print wheel 13 strikes the platen with reference to the start of the hammer fire pulse) resulting in position excursions of the carriage 10. These position excursions, from the desired position, of the carriage 10 during the print time resulted in horizontal positioning or alignment errors of the printed characters. The horizontal positioning or alignment measurement determines the amount a particular printed character deviates from its desired position with respect to the printed characters positioned on either side thereof.

It was desirable to reduce the horizontal alignment error of the printed character without performing a major redesign and beefing-up of the carriage 10 and the mounting thereof. During testing, the ribbon cartridge 16 and the ribbon advance motor 17 were removed to observe the effect on carriage oscillation and resulting horizontal positioning error. The test resulted in a marked reduction in the magnitude of the horizontal positioning error.

Figure 4:
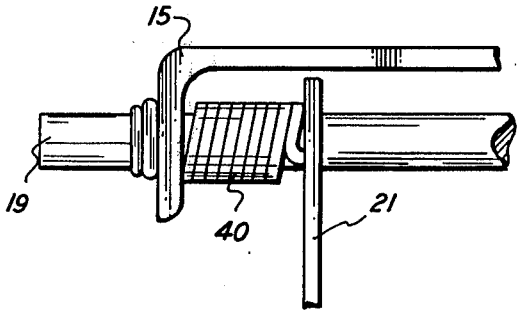
FIG. 4 is an enlarged rear elevation view of a portion of the carriage of FIG. 2 embodying the mounting principles of the present invention.

The carriage oscillations were reduced by changing the coupling between the ribbon associated components (ribbon cartridge mounting plate 15, ribbon cartridge 16, ribbon advance motor 17 and the ribbon advance gearing 18) and the remainder of the carriage 10. The change in coupling was accomplished by replacing the prior art coupling components of FIG. 3 (O-rings 31 and 32 and the DELRIN spacer 33) with spring 40 of FIG. 4. As is apparent from FIG. 2, only one-half of the mounting means (the left half) is shown in FIG. 4, with the other half, spring 41, shown in FIG. 2. With the carriage oscillations reduced by the resilient coupling means, the position excursions of the carriage 10 during the print time were reduced with the horizontal positioning error of the printed characters being within acceptable limits. It is felt that the resilient coupling means reduces the dynamic mass of the carriage 10 and its effect at print time caused by the rapid starting and stopping of the carriage 10.

Several different spring rates were tried and a critical range of values was determined to be from about 4.0 lbs/in to about 30.0 lbs/in. If the spring rate was too hard or high, then the dynamic mass of the carriage 10 was not sufficiently reduced by the resilient coupling means and the position excursions of the carriage 10 were too great causing the horizontal alignment or positioning of the printed characters to exceed the competitive print quality specification. If the spring rate was too soft or low, a problem could arise with the long lateral excursions taken by the ribbon at the print station. The ribbon would move so far that characters would strike the same portion of the single-strike ribbon which had already been struck by the previously printed character. This would cause a degradation in the print quality of the printed characters and was not acceptable; therefore, a trade-off was in order and the springs 40, 41 selected to be placed in the printer each had a spring rate of about 24.0 lbs/in, an outside diameter of about 0.24 inches, a free length of about 0.375 inches, four active coils and was made from wire of diameter of about 0.026 inches. To make certain that exterior forces would not interfere with the resilient coupling means associated with the ribbon cartridge mounting plate 15, the magnetic force supplied by electromagnet coils 20 was adjusted to a minimum value required to reliably perform the ribbon-lift function.

It is, therefore, understood that there has been shown an illustrative arrangement for use in a print wheel impact printer to provide a reduction in horizontal alignment error of the printed characters that fully satisfies the objects, aims and advantages set forth above. While the principles of the invention have been made clear in the illustrative embodiment, it is apparent that alternatives, modifications and variations will be evident to those skilled in the art. For example, the resilient coupling means is not limited to spring means but could encompass other elastic-type bodies or devices which recover their original shape when released after being distorted and during such distortion store up energy which is released upon the removal of the distorting force, e.g., polyester foam, elastomer, etc. Accordingly, it is intended to embrace all alternatives, modifications and variations as fall within the spirit and broad scope of the appended claims.

What is claimed is:

1. In a serial printer having a laterally movable carriage for traversing a printing line, print means supported on said carriage to print characters during a print time, ribbon cartridge support means and means for mounting said ribbon cartridge support means to said carriage, the improvement comprising:

said mounting means for said ribbon cartridge support means includes resilient coupling means operatively connected between the ribbon cartridge support means and remaining components of the carriage for reducing the position excursions of the carriage during print time, said resilient coupling means includes at least one spring having a spring rate between 4.0 lbs/in and 30.0 lbs/in.

2. The improvement of claim 1 wherein said spring is a compression spring.

* * * * *